US011120695B2

(12) United States Patent
Whelan

(10) Patent No.: US 11,120,695 B2
(45) Date of Patent: Sep. 14, 2021

(54) SYSTEM AND METHOD FOR FLIGHT DELAY PREVENTION IN REAL-TIME

(71) Applicant: The Boeing Company, Chicago, IL (US)

(72) Inventor: John Desmond Whelan, Burien, WA (US)

(73) Assignee: The Boeing Company, Chicago, IL (US)

( * ) Notice: Subject to any disclaimer, the term of this patent is extended or adjusted under 35 U.S.C. 154(b) by 226 days.

(21) Appl. No.: 16/263,665

(22) Filed: Jan. 31, 2019

(65) Prior Publication Data

US 2020/0250995 A1 Aug. 6, 2020

(51) Int. Cl.
*G08G 5/00* (2006.01)
*G07C 5/08* (2006.01)

(52) U.S. Cl.
CPC ..... *G08G 5/0039* (2013.01); *G07C 5/0808* (2013.01); *G07C 5/0816* (2013.01); *G08G 5/0021* (2013.01)

(58) Field of Classification Search
CPC ..... G08G 5/0039; G08G 5/0021; G08G 5/0013; G08G 5/0052; G07C 5/0808; G07C 5/0816; G07C 5/0825; G06Q 10/06
See application file for complete search history.

(56) References Cited

U.S. PATENT DOCUMENTS 4,943,919 A 7/1990 Aslin et al.
6,115,656 A 9/2000 Sudolsky
6,574,537 B2 6/2003 Kipersztok et al.
6,618,654 B1 9/2003 Zaat
6,691,007 B2 2/2004 Haugse et al.
6,751,536 B1 6/2004 Kipersztok et al.
7,065,433 B2 6/2006 Basu et al.
7,230,527 B2 6/2007 Basu et al.
7,860,618 B2 12/2010 Brandstetter et al.
8,340,948 B1 12/2012 Song et al.
8,730,064 B2 5/2014 Harrison et al.
8,825,276 B2 9/2014 Lake et al.
8,849,475 B1 9/2014 Sudolsky et al.
8,862,680 B2 10/2014 Gould et al.
8,874,459 B1 * 10/2014 Green ..... G06Q 10/08 705/7.22
10,395,197 B1 * 8/2019 Salam ..... G06Q 10/08
10,769,699 B1 * 9/2020 Joglekar ..... G06Q 30/0631
2002/0002548 A1 * 1/2002 Roundtree ..... H04W 8/005
2002/0138194 A1 * 9/2002 Flynn ..... G06Q 10/06 701/120

(Continued)

*Primary Examiner* — Rami Khatib
*Assistant Examiner* — Gabriel J Lambert
(74) *Attorney, Agent, or Firm* — Kwan & Olynick LLP

(57) ABSTRACT

In general, an improved flight delay prevention system is provided. Flight data, such as ARINC data, is acquired by a data acquisition device. Then a plurality of comparable objects using flight data is created. Each comparable object includes an object type and an object value. Then, one or more flight systems corresponding to possible delays is identified. Next, for each identified flight system, a comparable object is extracted and flight system is compared. Then, an ordered list of object type routes is obtained. A weighted average of all delay fields is then calculated. Finally, a current delay value is transmitted to a mobile device.

20 Claims, 17 Drawing Sheets

(56) References Cited

U.S. PATENT DOCUMENTS

| | | | | |
|---|---|---|---|---|
| 2003/0202527 | A1* | 10/2003 | Nahapetian | H03M 7/30<br>370/412 |
| 2009/0276250 | A1* | 11/2009 | King | G06Q 10/107<br>705/5 |
| 2012/0226647 | A1* | 9/2012 | Murray | G06Q 10/06<br>706/47 |
| 2015/0363981 | A1* | 12/2015 | Ziarno | G07C 5/0841<br>701/101 |
| 2016/0093221 | A1* | 3/2016 | Bailey | G08G 5/0039<br>701/120 |
| 2016/0093222 | A1* | 3/2016 | Hale | G08G 5/0021<br>701/120 |
| 2016/0240090 | A1* | 8/2016 | Marcella | G08G 5/025 |
| 2016/0293017 | A1* | 10/2016 | Whelan | G08G 5/0039 |
| 2018/0012499 | A1* | 1/2018 | Madhusudan | G08G 5/0013 |
| 2018/0374019 | A1* | 12/2018 | Basanets | G06Q 10/047 |
| 2019/0108758 | A1* | 4/2019 | Byravan | G08G 5/00 |
| 2019/0130769 | A1* | 5/2019 | Rodriguez Bravo | B64D 45/00 |
| 2020/0193841 | A1* | 6/2020 | D'Alto | G08G 5/0091 |
| 2020/0269995 | A1* | 8/2020 | Beaven | G07C 5/008 |

* cited by examiner

802

| Eq. ID | Equipment Type |
|---|---|
| 001 | Flight Control Computer (701) |
| 002 | Flight Management Computer (702) |
| 003 | Thrust Control Computer (703) |
| 004 | Inertial Reference System (704) |
| 005 | Recorded Altitude (705) |
| 006 | Air Data System (706) |
| 007 | Altimeter (707) |
| 008 | Airborne Weather Radar (708) |
| 009 | Airborne DME (709) |
| 00A | FAC (A310) |
| ⋮ | ⋮ |

FIG. 8

SYSTEM AND METHOD FOR FLIGHT DELAY PREVENTION IN REAL-TIME

TECHNICAL FIELD

The present disclosure relates generally to aviation systems, and, more specifically, to flight delay prevention.

BACKGROUND

Aircraft delays cause major problems for both airlines and their customers. Besides the inconvenience, delayed flights can cost airlines in terms of lost revenue, added expenditures, and wasted time. Thus, airlines organize their schedules to operate efficiently, in order to generate the most income possible within a given time period. Any disruption to these schedules can have cascading effects, e.g., delayed flight causing a chain reaction of subsequent delayed flights. As a result, these cascading delays create problems for non-problematic on-scheduled flights as well.

Even if an airline is well organized, this does not guarantee its flights won't encounter a delay. In general, delays are difficult to predict, and consequently account for, because almost anything can cause a delay. For example, bad weather, unplanned turbulence, airport constraints, mechanical issues, runway backups, passenger disruptions, heavy airline traffic, etc., can all cause delays, alone or in combination. Thus delays are a universal problem affecting all airlines and their customers. Therefore, there exists a need for improved delay prevention in airline scheduling.

SUMMARY

The following presents a simplified summary of the disclosure in order to provide a basic understanding of certain embodiments of the present disclosure. This summary is not an extensive overview of the disclosure and it does not identify key/critical elements of the present disclosure or delineate the scope of the present disclosure. Its sole purpose is to present some concepts disclosed herein in a simplified form as a prelude to the more detailed description that is presented later.

In general, certain embodiments of the present disclosure provide systems, methods and computer readable media for flight delay prevention. In one aspect, a system is provided comprising a mobile device, a data acquisition device, a processor, and memory. The data acquisition device is configured to retrieve flight data from a plurality of different flight systems. The memory stores instructions for executing a method, the method comprises: retrieving flight data from the data acquisition device creating a plurality of comparable objects using the flight data, wherein each comparable object is an instantiation of an object type containing a plurality of attributes associated with the object, wherein each comparable object includes an object type and an object value; identifying one or more flight systems that correspond to possible delays; extracting, for each identified flight system, a comparable object from the plurality of comparable objects, where the object type equals flight systems and the object value equals the identified flight system; comparing, for each identified flight system, the identified flight system to historical flight systems of the same type; obtaining an ordered list of object type routes based on comparing the identified flight system to the historical flight systems, wherein each route in the ordered list of routes includes a delay field; calculating a weighted average of all the delay fields in the ordered list to produce a current delay value; and transmitting the current delay value to the mobile device.

In some embodiments, the plurality of attributes comprises physical and non-physical attributes. In some embodiments, a weight for the weighted average is determined by a score for the ordered list as a result of comparing the identified flight system to the historical flight systems, wherein the score is a real number between 0 and 1. In some embodiments, the flight data is binary data, the binary data having a structure of frames, sub-frames, and systems. In some embodiments, creating the plurality of comparable objects includes mapping binary flight data into system objects. In some embodiments, comparing identified flight system includes comparing object type system data to produce object type route data. In some embodiments, the method further comprises transmitting a delay source and alternative routes.

In other aspects of the present disclosure, a method and a computer readable medium are provided. The method comprises the steps outlined above with regard to system. The computer readable medium stores instructions for executing the same.

BRIEF DESCRIPTION OF THE DRAWINGS

The disclosure may best be understood by reference to the following description taken in conjunction with the accompanying drawings, which illustrate particular embodiments of the present disclosure.

FIG. 8 illustrates an example list of flight systems, in accordance with one or more embodiments of the present disclosure.

DETAILED DESCRIPTION OF PARTICULAR EMBODIMENTS

Figure 1:
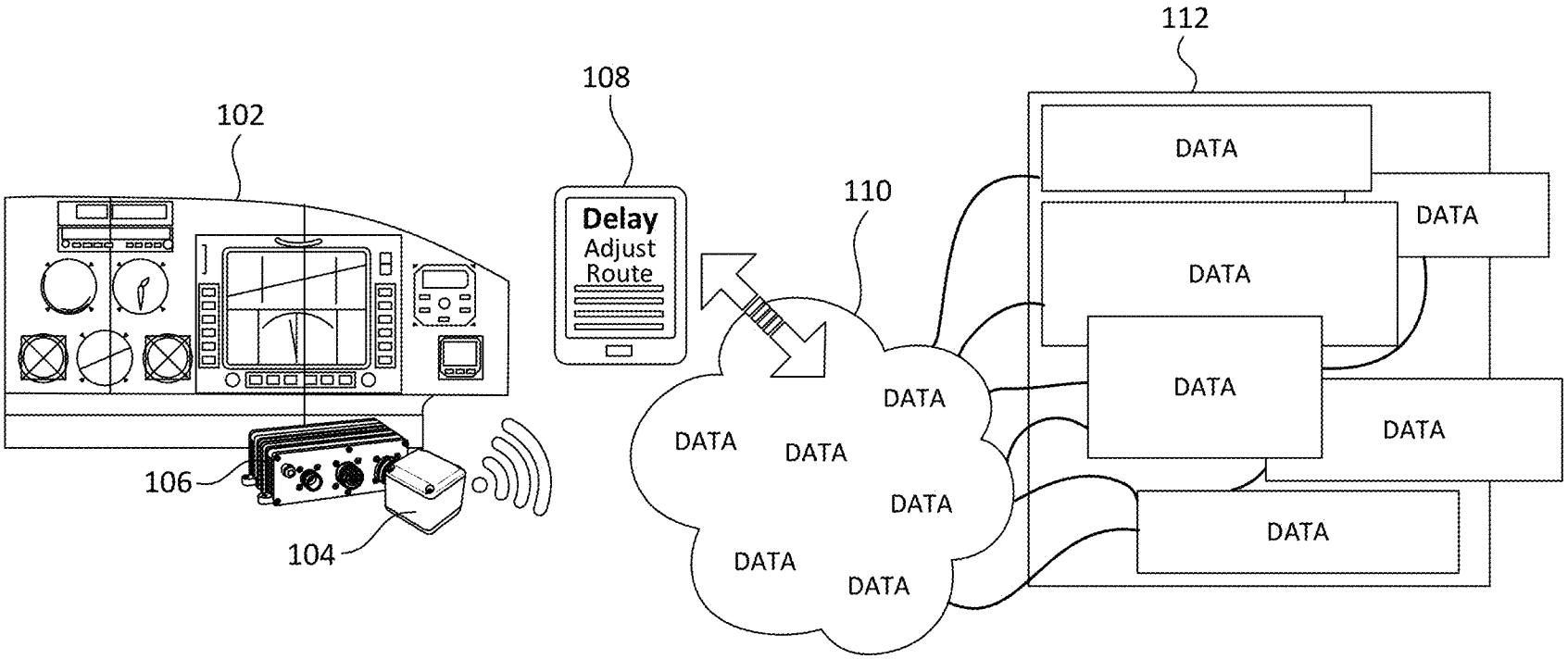
FIG. 1 illustrates an abstract view of an example of flight delay prevention system, in accordance with one or more embodiments of the present disclosure.

Reference will now be made in detail to some specific examples of the present disclosure including the best modes for carrying out the systems and methods provided in the present disclosure. Examples of these specific embodiments are illustrated in the accompanying drawings. While the present disclosure is described in conjunction with these specific embodiments, it will be understood that it is not intended to limit the present disclosure to the described embodiments. On the contrary, it is intended to cover alternatives, modifications, and equivalents as may be included within the spirit and scope of the present disclosure as defined by the appended claims.

In the following description, numerous specific details are set forth in order to provide a thorough understanding of the present disclosure. Particular example embodiments of the present disclosure may be implemented without some or all of these specific details. In other instances, well known process operations have not been described in detail in order not to unnecessarily obscure the present disclosure.

Various techniques and mechanisms of the present disclosure will sometimes be described in singular form for clarity. However, it should be noted that some embodiments include multiple iterations of a technique or multiple instantiations of a mechanism unless noted otherwise. For example, a system uses a processor in a variety of contexts. However, it will be appreciated that a system can use multiple processors while remaining within the scope of the present disclosure unless otherwise noted. Furthermore, the techniques and mechanisms of the present disclosure will sometimes describe a connection between two entities. It should be noted that a connection between two entities does not necessarily mean a direct, unimpeded connection, as a variety of other entities may reside between the two entities. For example, a processor may be connected to memory, but it will be appreciated that a variety of bridges and controllers may reside between the processor and memory. Consequently, a connection does not necessarily mean a direct, unimpeded connection unless otherwise noted.

Overview

The present disclosure provides comparable objects and attributes from data parameters, such as Aeronautical radio Inc. (ARINC) data parameters, obtained from a data acquisition device, such as an Aircraft Interface Device (AID). A mobile device uploads this data from the AID using a wired or wireless connection. Then, the device uses attribute association, as described further herein, to compare its data with other similar route objects sharing the same attributes.

The system then uses the results from these route comparisons to calculate if a potential delay is present within the sought route. If a delay is present, the system notifies the pilot, so he or she can adjust their route in order to avoid a delay. Furthermore, the system may also supply alternative delay-free routes which are similar to the sought route.

Example Embodiments

The present disclosure provides a system and method for preventing aircraft delays for a particular route while inflight (i.e. in real-time). Most current solutions to this problem rely on treating the symptoms rather than the cure. In particular, airlines can address problems with weather or maintenance, which could be the reasons behind a delay. However, delays themselves still continue to occur.

Common methods used for predicting delays usually rely on information provided by external sources, such as other pilots or air traffic controllers. These methods rely heavily on numeric data and tend to ignore any other data types that might otherwise provide valuable insight. In addition, they rarely provide variation for non-tangible aspects, like weather patterns, airline turmoil, landing conditions or passenger loads. Such solutions also fail to use all available information, which otherwise could be provided by this invention.

Other solutions to this problem rely on a pilot's intuition and or experience. However, these traits cannot be measured and vary from situation to situation, and from pilot to pilot. Thus, a more reliable solution is needed.

The disclosed system creates comparable assets from data, such as ARINC data. It gathers these assets from each flight system via a connection from Digital Flight Data Acquisition Unit (DFDAU) to an Aircraft Interface Device (AID). Using autonomous software within the AID, the invention reiterates through each system which might influence a potential delay comparing it with systems of previous flights to isolate any commonalties which lengthen an aircraft's flight, thereby contributing to the delay.

Thus, the disclosed system provides a more inclusive and non-static alternative to more traditional-like solutions. According to various embodiments, the system also provides several different advantages. According to various embodiments, the system utilizes many additional factors when evaluating routes, which otherwise would be ignored. It uses attribute association which exploits aspects of data which conventional means do not. It even uses black box flight data, which many systems cannot utilize in flight because they do not have the means to interpret the data into something meaningful. In addition, the system operates in real-time while an aircraft is inflight by providing a non-static solution for preventing delays with concerns to a particular route. Further, in some embodiments, the system is language independent and universally deployable.

The present disclosure includes the ability to compare data, by using an interface to decipher ARINC data programmatically. This interface can vary in scope and functionality, but preserves the job of recognizing parameters within ARINC data in whatever capacity the interface can handle. In some embodiments, the technology outlined within this disclosure supports other aircraft communication protocols as well. In some embodiments, the AID described within this disclosure could take many forms, including portable, built-in, factory-installed, expansion board, etc. In addition, the type of information used is not limited to the ones that are described herein.

As used herein, the term "Route" is synonymous with an aircraft flight. However, it is recognized that the advantages provided in this disclosure are not simply limited to airlines. Other forms of transportation may also benefit from the methods and systems described herein. In addition, the advantages provided herein are not only limited to preventing delays. Other preventative purposes may also benefit from this disclosure as well.

It is recognized that the calculations presented herein represent just one method of calculation used in some embodiments to determine delays (using discrepancies between the scheduled flight times and the actual flight times). In other embodiments, the calculations could differ. In some embodiments, it is assumed the route data is preloaded or accessed from a network. In some embodiments, current flight data is archived for future use in the attribute association object format. In some embodiments, the technology used to correlate the route data described within this document could exist within the mobile device itself, or on a network server accessible by the mobile device.

In addition, the system and method disclosed herein provide improvements to the functioning of flight computer systems themselves. The system provided herein has the ability to create comparable assets in the form of objects and attributes from ARINC Data and incorporate attribute association comparisons with that data in order to detect potential delays with concerns to a particular flight or route. Currently, there does not exist a way to "utilize" unrelated and/or incompatible data in flight delay calculation in the same manner. However, the system and method disclosed herein allow a more accurate calculation of flight delay using seemingly unrelated data. In addition, black box flight data is not readily in interpretable and/or translatable format to be used in flight. However, the system provided herein is capable of incorporating black box data into a more accurate flight delay calculation. The more accurate flight calculation allows for more efficient operation of flight systems as a whole since the cascading delays are reduced in general. More efficient operation of flight systems also leads to more efficient resource allocation, which leads to faster software and hardware operation in flight.

FIG. 1 illustrates an abstract view of an example of flight delay prevention system, in accordance with one or more embodiments of the present disclosure. FIG. 1 includes flight deck 102, AID 104, ARINC data port 106, mobile device 108, historical data 110, and route comparisons 112. In some embodiments, ARINC data is a protocol that defines a standard of data communication created by an organization composed of major airlines and aircraft manufactures that seek to promote standardization within aircraft equipment. In some embodiments, the route comparisons are made using a process called attribute association, as described in further detail below.

In some embodiments, the AID describes a portable device which connects directly to a communication port in order to obtain binary flight data. In some embodiments, AID 104 creates and transfers the objects and attributes of the flight systems which could influence a delay to mobile device 108. In some embodiments, AID 104 provides a secured wireless hotspot or access point. Then, mobile device 108 connects to it when in range of the (wireless) network. In some embodiments, the connection and data transfer requires dual authentication. Once connected, the disclosed system triggers the transfer and notifies the user of the device.

Figure 2:
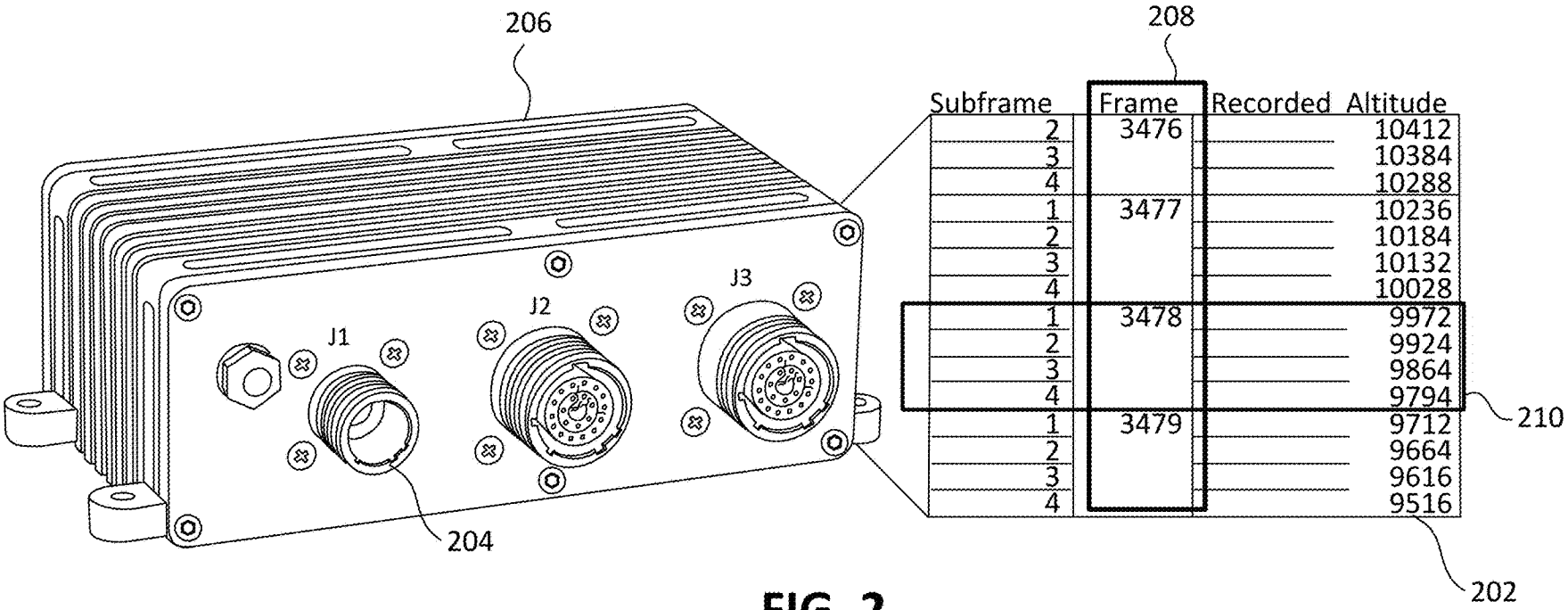
FIG. 2 illustrates an example of an ARINC Communication Port, in accordance with one or more embodiments of the present disclosure.

FIG. 2 illustrates an example of an ARINC Communication Port 206, in accordance with one or more embodiments of the present disclosure. As mentioned above, ARINC is a protocol that defines a standard of data communication. Within an aircraft, this communication occurs between the Digital Flight Data Acquisition Unit (DFDAU) and the Flight Data Recorder. The FAA (Federal Aviation Administration) mandates this protocol, making its structure very reliable. In some embodiments, in addition to feeding the Flight Data Recorder, an aircraft also provides a port 204 to access this data as well, as shown in FIG. 2.

In some embodiments, ARINC data 202 includes status information received from different components within an aircraft. For example, the data could be information regarding the altitude or the position of the rudder at a certain point in time. The data elements, recorded as parameters, are classified into frames 208 and subframes 210. A frame 208 is a repeated pattern which lasts for four seconds. A subframe 210 is a one-second pattern within the four second frame. Therefore, there are four subframes to each frame. In some embodiments, each subframe has its own synchronization pattern at the start to identify it.

Figure 3:
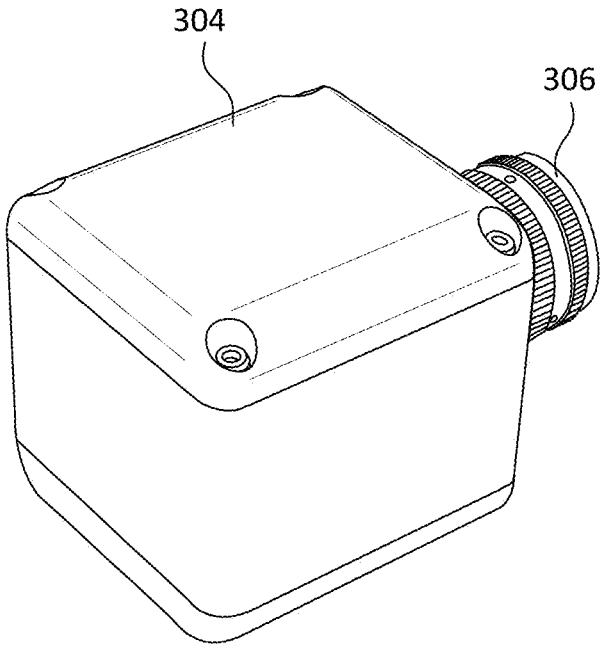
FIG. 3 illustrates an example of an Aircraft Interface Device (AID), in accordance with one or more embodiments of the present disclosure.

FIG. 3 illustrates an example of an Aircraft Interface Device (AID), in accordance with one or more embodiments of the present disclosure. As previously mentioned, an "AID" describes a portable device which connects directly to a communication port in order to retrieve flight data, as shown in FIG. 3. The AID could take many forms. However, for the purpose of this disclosure, the AID in FIG. 3 includes a housing unit 304 and a connection module 306.

In some embodiments, the housing unit contains built in software which allows it to operate autonomously. In such embodiments, this includes an operating system, a development environment or runtime interpreter (i.e. Java (R) Runtime Environment, JRE), a wireless access point, authentication credentials and or any other software necessary for its operation. In some embodiments, it is possible to replace a portable AID with a factory installed built-in device, thus eliminating the need for an external apparatus.

In some embodiments, the AID provides an interface to flight data which is otherwise difficult to obtain. In such embodiments, the AID converts binary flight data from the flight system into a more useable format. Then, it transmits the newly-formed data using a wired or wireless connection to an authenticated (mobile) device.

In some embodiments, AIDs provide an example of how new aircraft technologies are broadening the use of tablets in cockpits as replacements for paper-based charts by providing more access to aircraft data.

Figure 4:
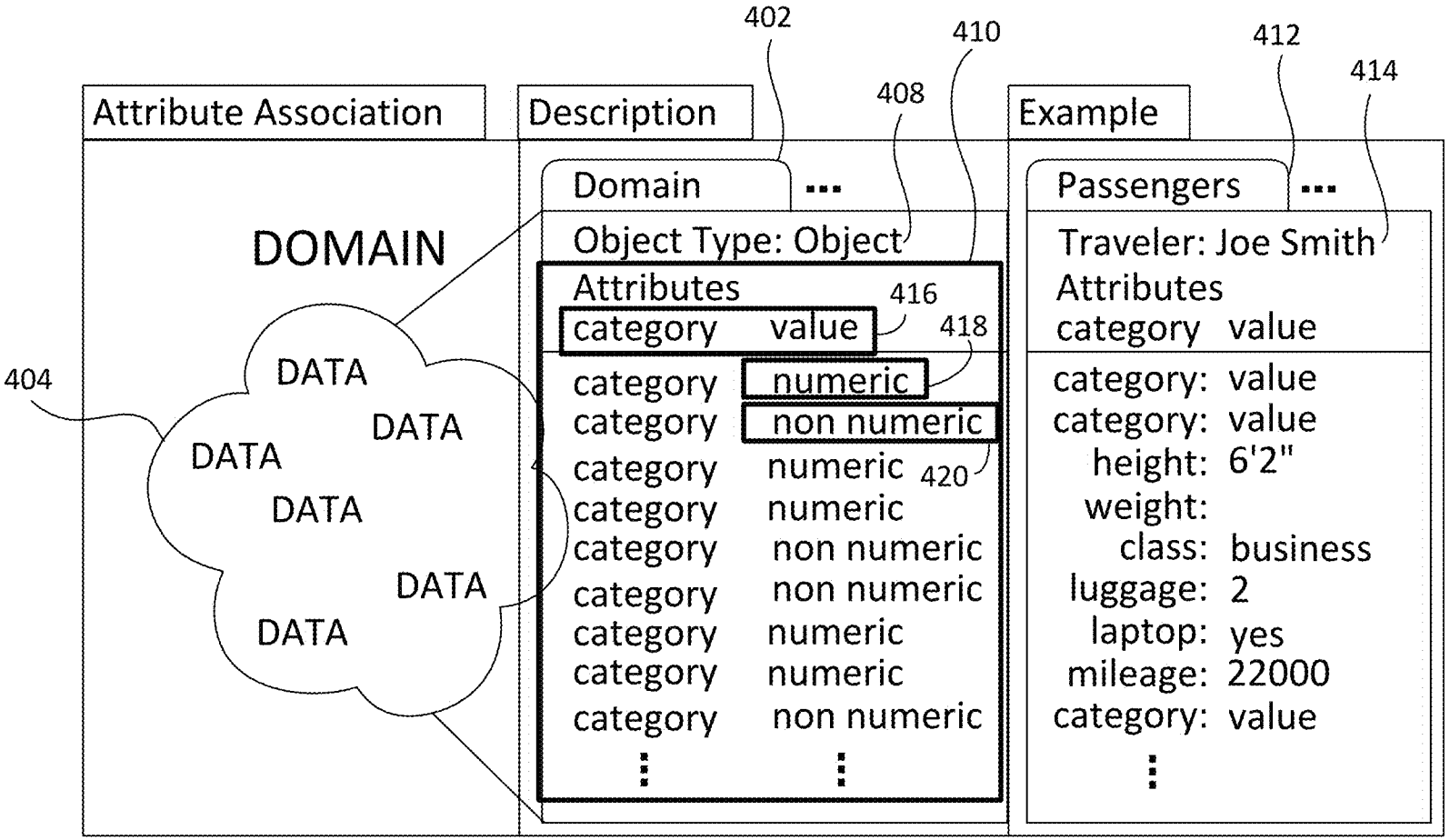
FIG. 4 illustrates an example depiction of attribute association, in accordance with one or more embodiments of the present disclosure.

FIG. 4 illustrates an example depiction of attribute association, in accordance with one or more embodiments of the present disclosure. As described earlier, in some embodiments attribute association is used to compare routes. FIG. 4 depicts information as a cloud 404. In some embodiments, the system logically divides this information into perspectives and domains 402. A perspective provides a "point of view" or an initial context for a user's domain. For example, "Passengers" 412 could be a perspective within an Airline Domain.

In some embodiments, attribute association uses the attributes of objects to perform comparisons. In some embodiments, an object is an instantiation of an object type 408. For example, an object type could be a "Traveler", whereas an actual object would be an instantiation of that type, like a real traveler: Joe Smith 414. In some embodiments, an object could also be intangible or abstract, such as a passenger's travel habits.

In some embodiments, each object contains a set of attributes 410 used to describe it. In some embodiments, attributes use a category and a corresponding value 416 to define aspects of an object. In some embodiments, each attribute value can be either numeric 418 or non-numeric 420. In addition, in some embodiments, attributes can be object types as well.

Attribute association uses these attribute categories and values to perform comparisons, by matching categories and then comparing their values. For numeric values, a radius option allows for corresponding attribute values to match within a certain percentage.

Figure 5:
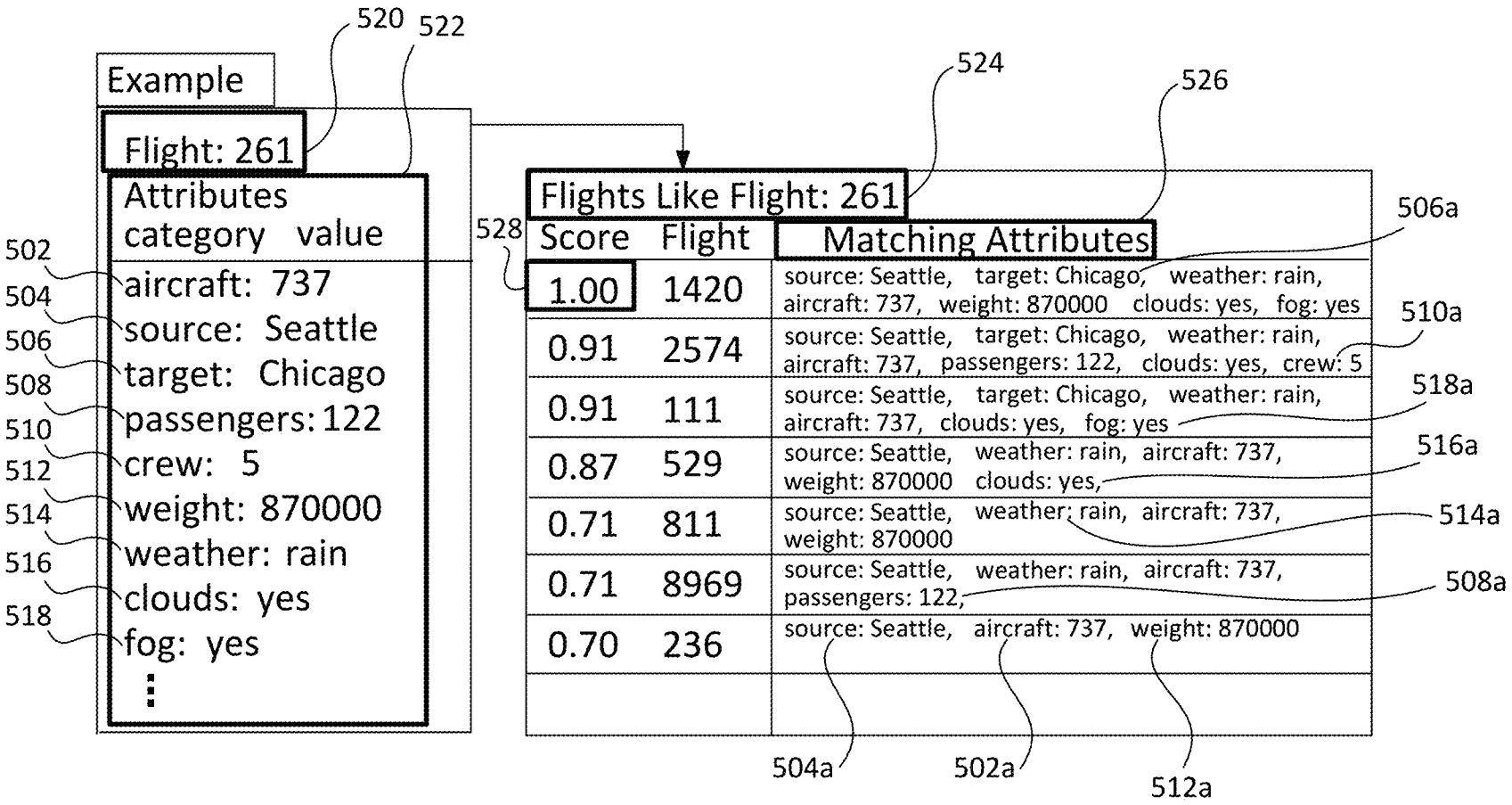
FIG. 5 illustrates an example of attribute association comparison, in accordance with one or more embodiments of the present disclosure.

FIG. 5 illustrates an example of attribute association comparison, in accordance with one or more embodiments of the present disclosure. In some embodiments, attribute association comparisons are used to compare objects. Each object 520 contains a set of attributes 522. In some embodiments, the comparison collects these attributes as category and value pairs. In some embodiments, if a category and value of the intended object match another category and value of a different object, that comparison counts towards the overall comparison of the two objects. For example, attributes 522 may include one or more of an aircraft 502, a source or origination of a flight 504, a target or destination of the flight 506, a number of passengers on the flight 508, a number of crew operating the aircraft 510, a weight of an aircraft 512, a weather forecast for the destination of the flight 514, whether clouds are present or predicted at the destination 516 at the time of arrival, and whether fog is present or predicted at the destination 518 at the time of arrival.

FIG. 5 illustrates an example of attribute mapping, matching attributes 522 of object 520 with matching attributes 526 of matching object 524. Eventually, the comparison sums up these matches to calculate which objects are most alike. In some embodiments, the results consist of an ordered list of objects, citing the matching attributes of each in order of relevance. In addition, in some embodiments, a score 528 is given to each comparison which ranks it among the other results.

Figure 6:
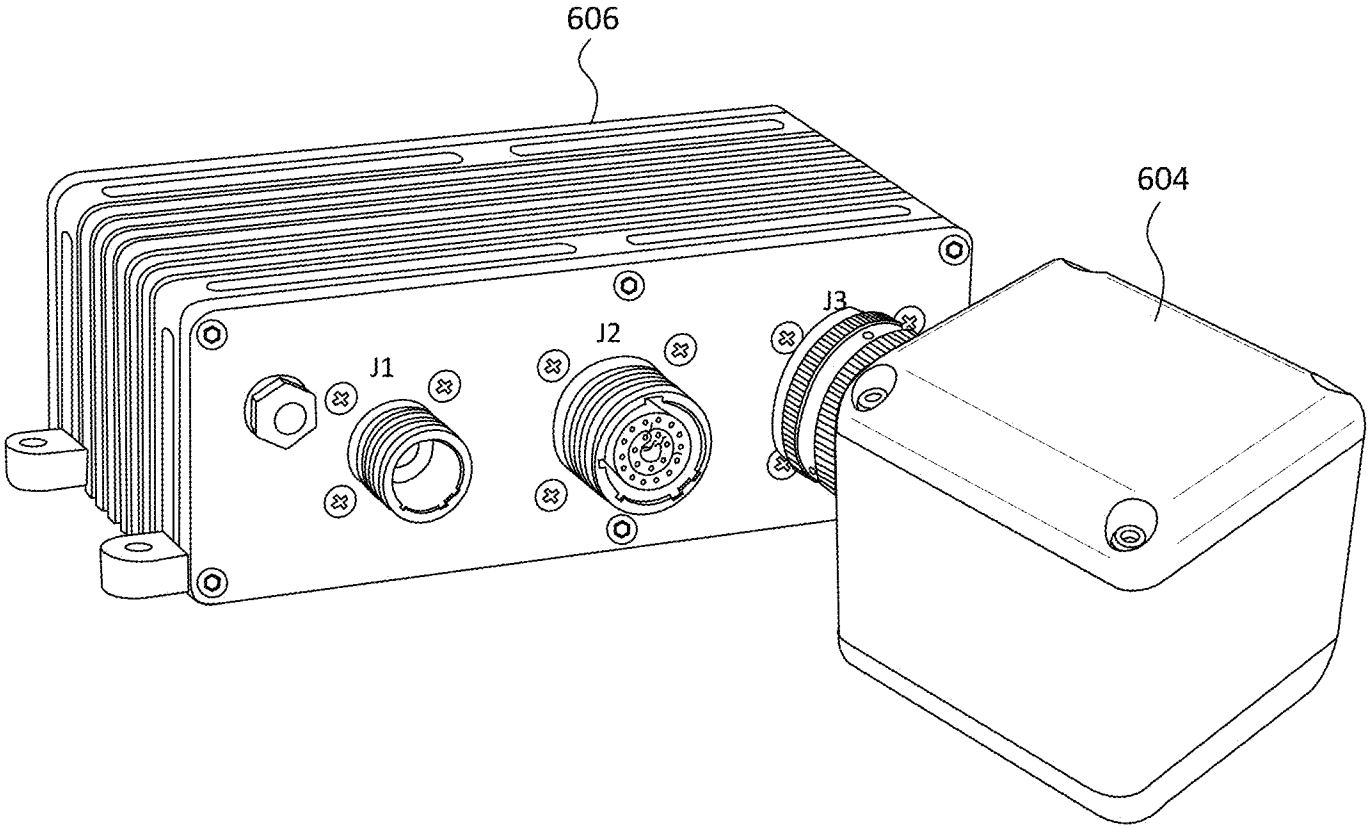
FIG. 6 illustrates an example of an AID connected to a communication port, in accordance with one or more embodiments of the present disclosure.

FIG. 6 illustrates an example of an AID connected to a communication port, in accordance with one or more embodiments of the present disclosure. In some embodiments, the software within the AID 604 to connect to a communication port 606 within the flight deck in order to obtain the ARINC data. In some embodiments, the system contains autonomous software which allows it to collect binary data from the port and then use it to detect possible delays.

Figure 7:
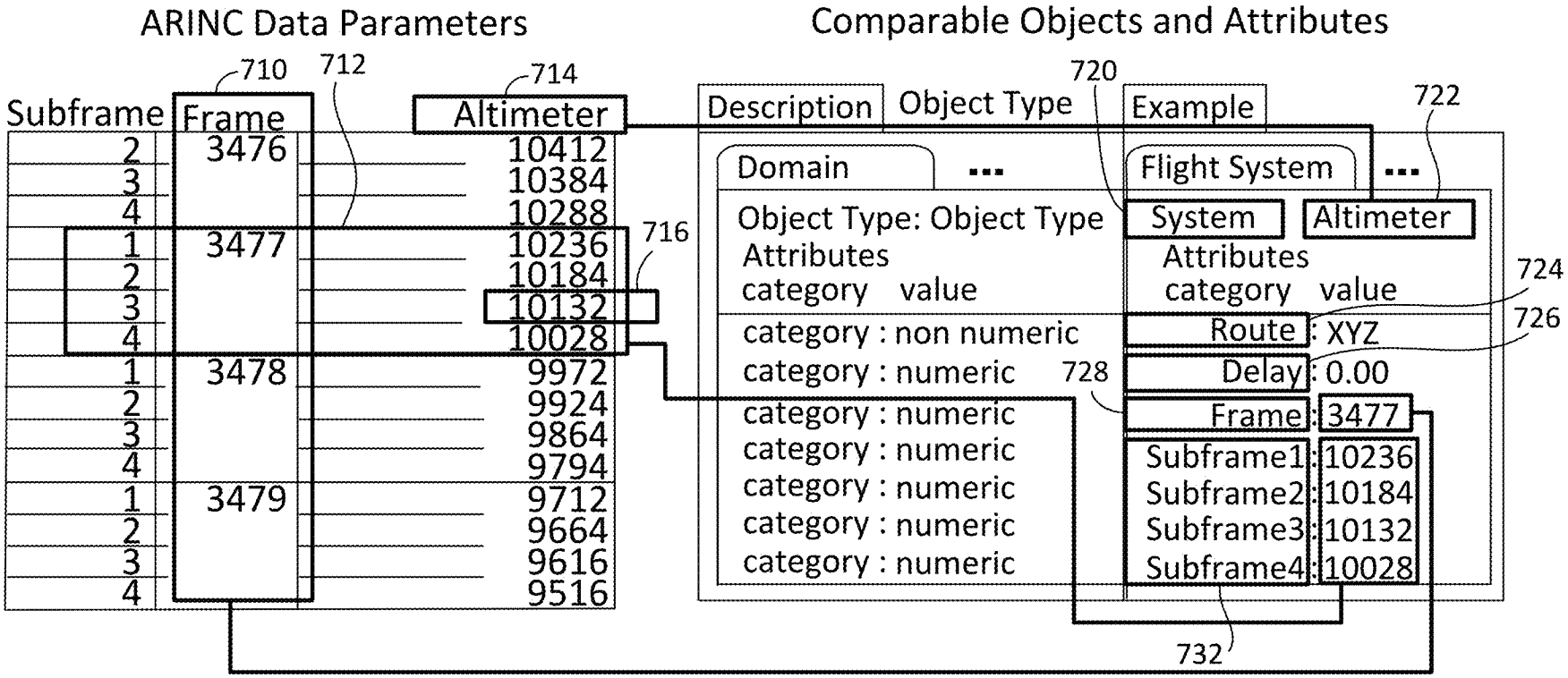
FIG. 7 illustrates an example of creating objects and attributes from ARINC data, in accordance with one or more embodiments of the present disclosure.

FIG. 7 illustrates an example of creating objects and attributes from ARINC data, in accordance with one or more embodiments of the present disclosure. As shown in FIG. 7, the ARINC data protocol separates each parameter 714 into frames and subframes. Each four second frame 710 consists of four one second subframes 712. The values for the parameter 716 reside within each subframe. Although the example illustrates data obtained from the Altimeter, data from other flight systems are available as well. In the case of delays, most flight systems provide useful data.

In some embodiments, attribute association uses the attributes of objects to perform comparisons. As previously mentioned, in some embodiments, an object is an instantiation of an object type. In this example, for this domain, the flight systems 720 of an aircraft will serve as the object type, whereas an actual object would be an instantiation of that type, like a real system such as the Altimeter 722. Furthermore the attributes used to describe this object would be the route identifier 724, the delay 726, the frame 728 and the four subframes 732, individually identified as Subframe1, Subframe2, Subframe3 and Subframe4. In some embodiments, the route identifier 724 would be an object type, as the results of the comparison would be in routes. In the example provided in FIG. 7, it is important to link each matching system with its corresponding route.

FIG. 8 illustrates an example list of flight systems, in accordance with one or more embodiments of the present disclosure. List 802 represents avionics systems within an aircraft. Each system reports real-time status as it relates to the current flight. If the status of the system has the potential for causing a delay, the system includes it within its list of comparisons. Furthermore the disclosed system maintains an additional list of flight systems which have a history of affecting the length of a flight, as a result the disclosed system automatically flags those systems as well.

In some embodiments, software on the mobile device compares the attributes of a flight system within the current route to the attributes of other flight systems within other routes. In order to accomplish this, the mobile device uses attribute association comparisons.

Typically, these comparisons return results of the same type as the queried type. For instance, finding Students like Joe Smith would return an ordered list of Students (like Joe Smith), because Joe Smith is a Student. However, it is possible to return results of a different type, other than the queried type. For example, find Courses like Joe Smith. In that example, the results would be Courses, not Students, which are like Joe Smith.

Figure 9:
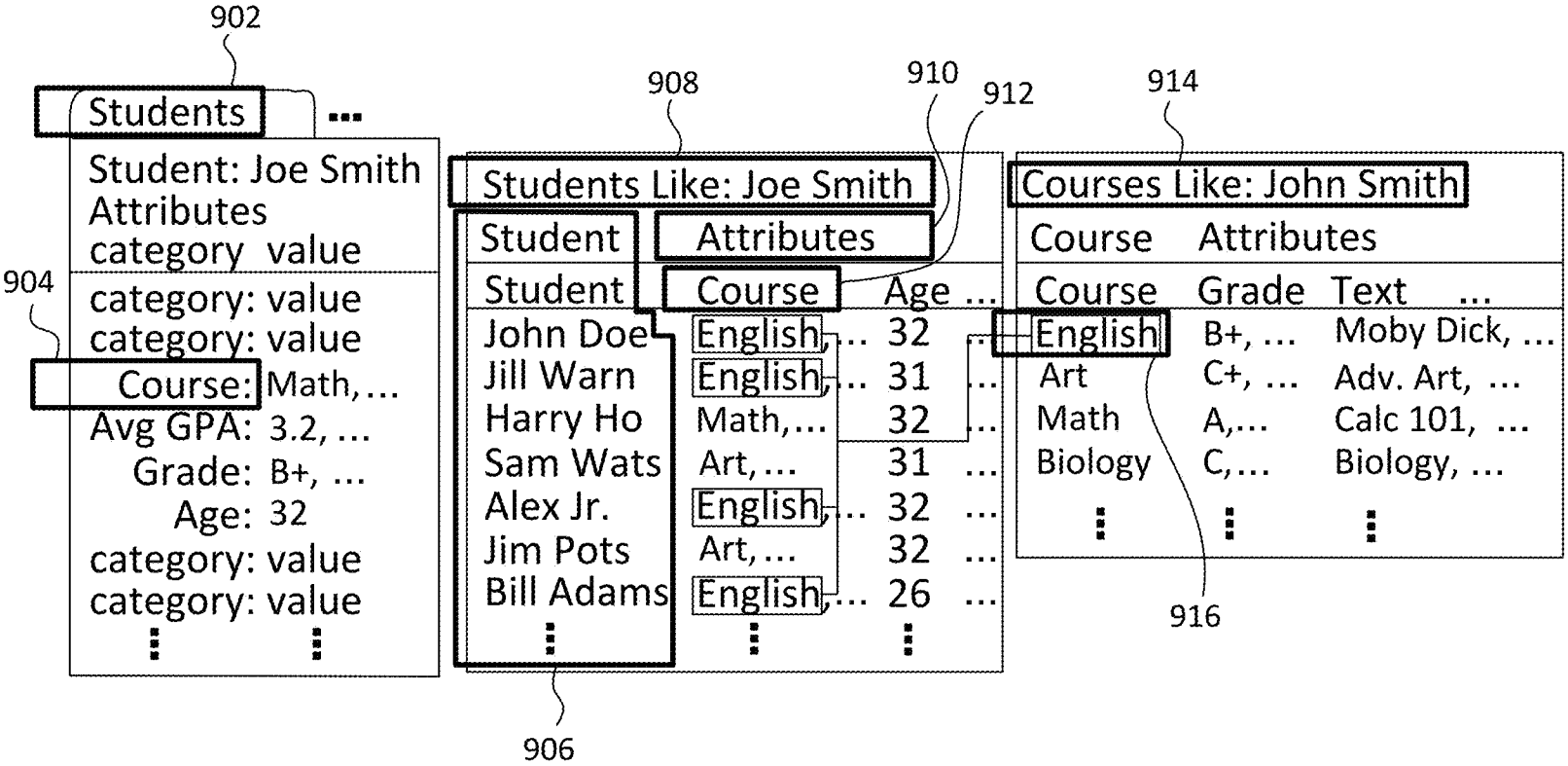
FIG. 9 illustrates an example of attribute association comparison of a different type, in accordance with one or more embodiments of the present disclosure.

FIG. 9 illustrates an example of attribute association comparison of a different type, in accordance with one or more embodiments of the present disclosure. As shown in FIG. 9, attribute association achieves this by returning an attribute of the queried object as the object type of the resulting set. For example, Course 904 is an attribute of a Student 902. The comparison results of Students like Joe Smith 908 return an ordered list of Students 906 with selected attributes 910. One of those attributes is Course 912, which are the courses that students like Joe Smith are taking. The query could have returned that Course as the object type when queried for courses like Joe Smith 914, as long as Course is also classified as an object type. As a result, English 916 is the course most like Joe Smith. In some embodiments, when assembling the comparison, the return type does not usually factor into the calculation of the query. In such embodiments, the return type is then marked as meta-data.

In some embodiments, the flight delay prevention system reiterates through each flight system object provided by the AID, comparing them with previous flight system objects and returns the route object as the result of that comparison, using the process previously described (returning results of a different type). In such embodiments, the results are an ordered list of routes which correspond with each flight system, placing the most similar first.

Figure 10:
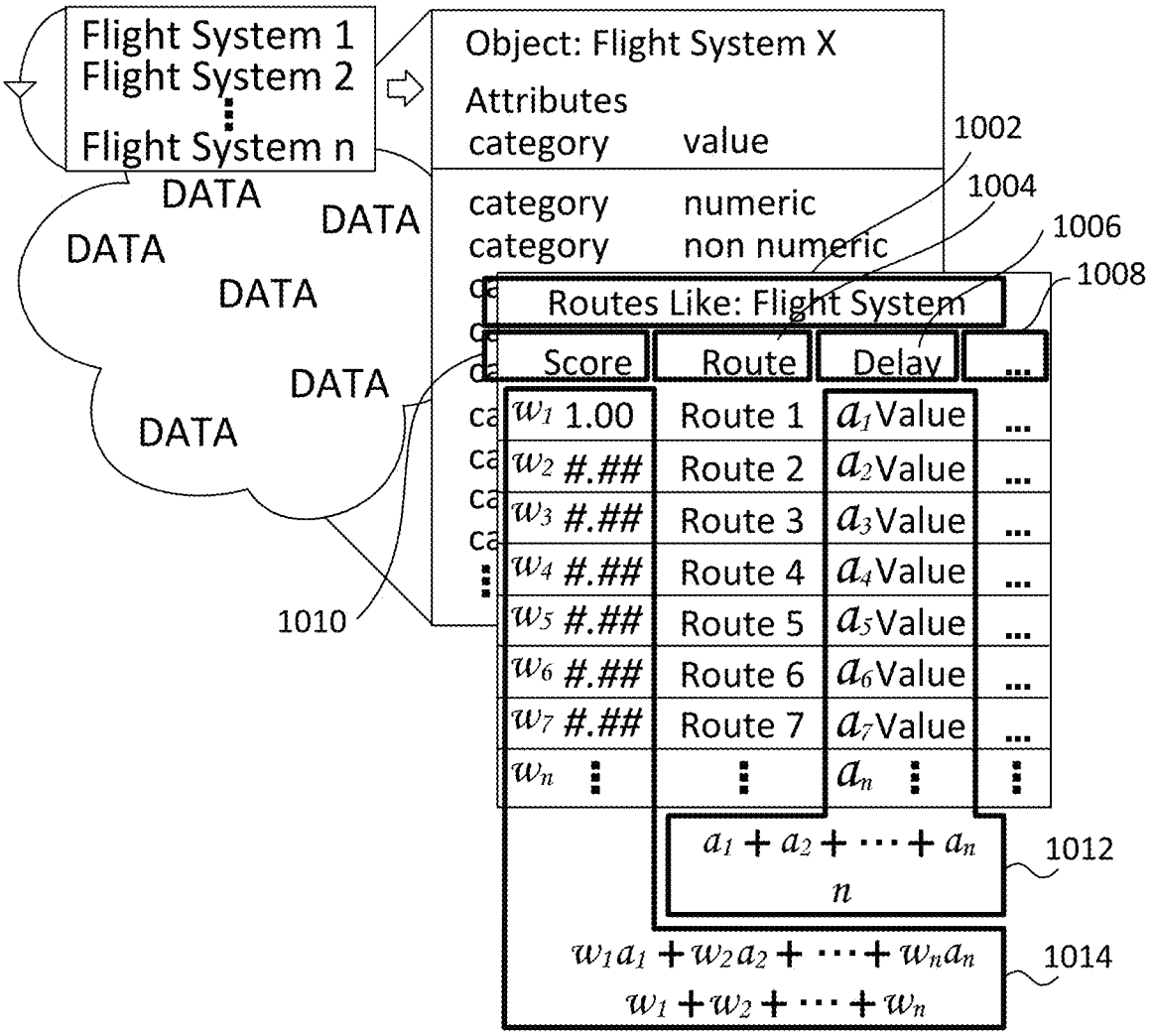
FIG. 10 illustrates an example of attribute association comparison with combined averages, in accordance with one or more embodiments of the present disclosure.

FIG. 10 illustrates an example of attribute association comparison with combined averages, in accordance with one or more embodiments of the present disclosure. As shown above in FIG. 10, the results contain a list of routes 1002 which share common attributes with the flight system of the sought route. In some embodiments, included with the results is a score 1010, a route identifier 1004 and a delay value field 1006 among other attributes 1008 as well. In some embodiments, additional attributes could include alternative routes and or delay sources. In some embodiments, the disclosed system could relay this information back to the user (pilot).

In some embodiments, once the disclosed system obtains similar routes, it uses the delay value field from those routes to predict the potential for a delay with the intended route.

The disclosed system uses the combined average 1012 or weighted combined average 1014 to make its prediction. In some embodiments, the disclosed system formulates its prediction in the length of time of the delay. The sum of the combined averaged delay value indicates if the current flight has the potential for a delay, if this value is greater than zero.

Figure 11:
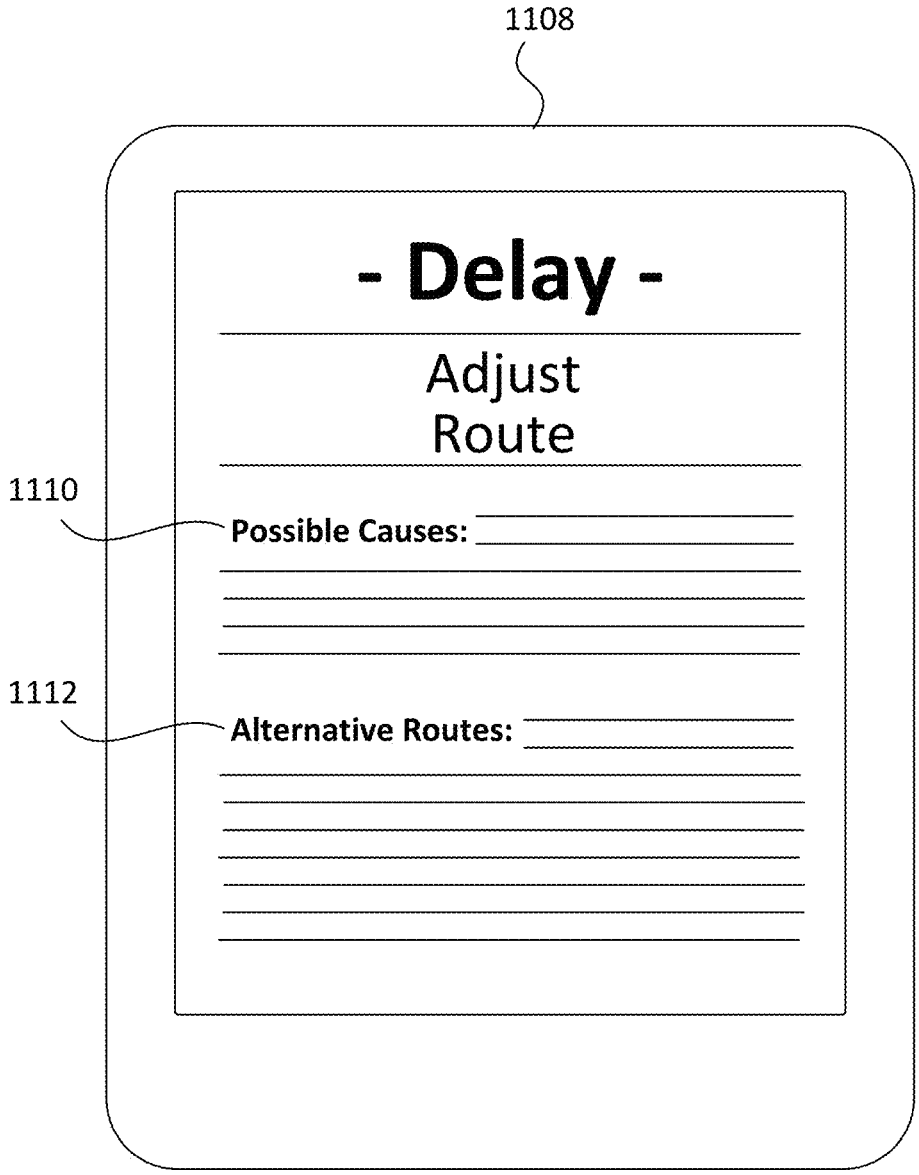
FIG. 11 illustrates an example of displaying delay information on a mobile device, in accordance with one or more embodiments of the present disclosure.

According to various embodiments, the outcome of the attribute association comparison reveals if a delay is likely, based on the flight's current route. If the route's characteristics match those of similar past flights, which have also experienced a delay, then the current flight could suffer a delay as well. FIG. 11 illustrates an example of displaying delay information on a mobile device 1108, in accordance with one or more embodiments of the present disclosure. The disclosed system uses software within the mobile device 1108 to interpret the results of the comparison and relay that information back to the pilot, as shown in FIG. 11. Based on this information, the pilot can then take the appropriate action and potentially avoid a delay. The device 1108 could also provide additional information on how it reached its decision 1110 and or suggest alternative routes (e.g. possible remedies) 1112.

Figure 12:
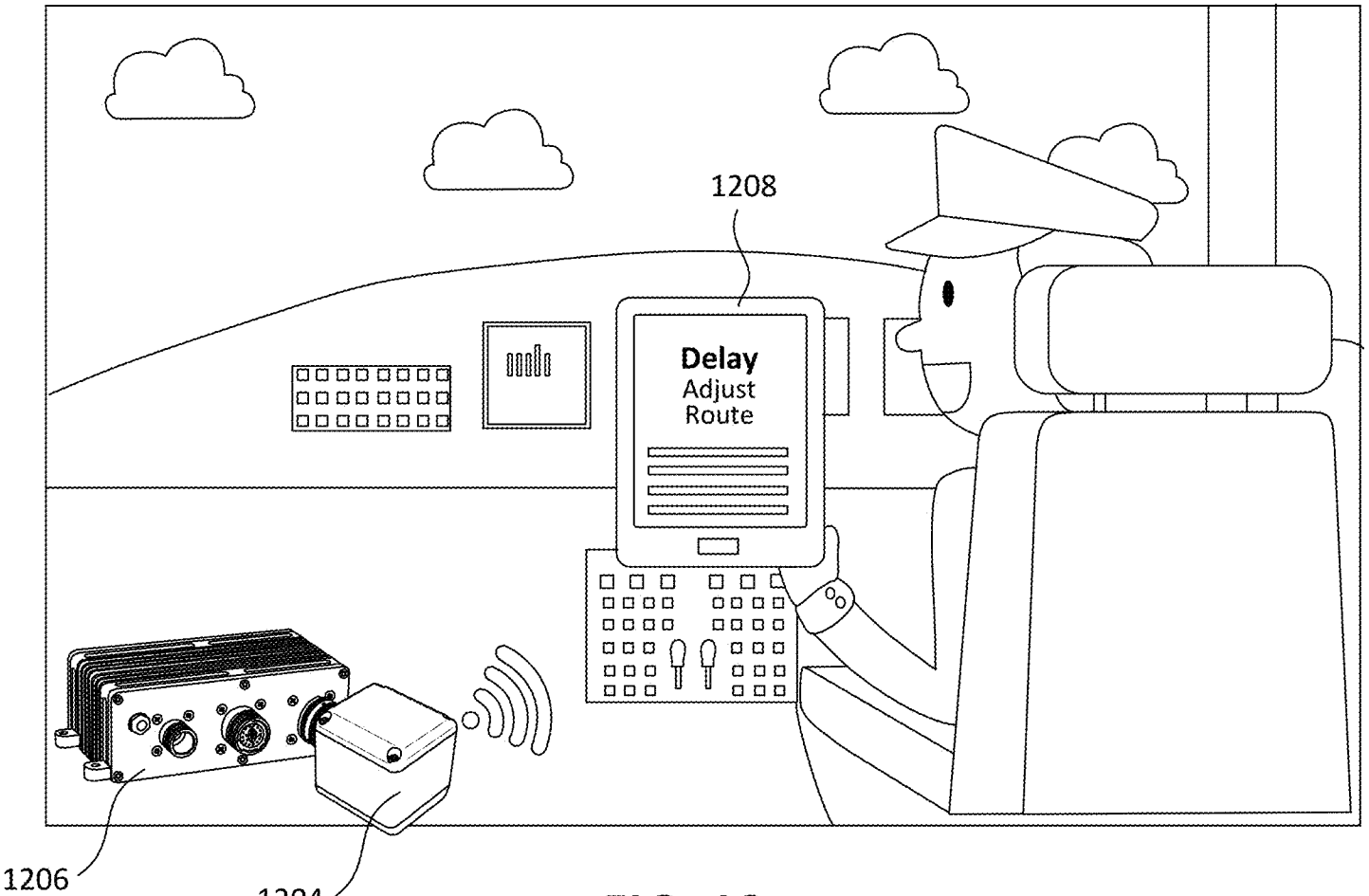
FIG. 12 illustrates an example of a preferred physical embodiment of a flight delay prevention system in use, in accordance with one or more embodiments of the present disclosure.

FIG. 12 illustrates an example of a preferred physical embodiment of a flight delay prevention system in use, in accordance with one or more embodiments of the present disclosure. As shown, the disclosed system uses a connection port 1206 coupled with an Aircraft Interface Device (AID) 1204. In some embodiments, this combined apparatus could be a built-in pre-connected factory installed unit, hidden within the electronics of the aircraft.

In some embodiments, AID 1204 provides a secure wireless network. The pilot accesses flight data through this network using their mobile device 1208. In some embodiments, the mobile device 1208 contains software which informs the pilot if a delay is possible with concerns to the current flight or route. The disclosed system could provide the pilot with further instructions, in the form of alternative routes and or delay sources.

Figure 13A:
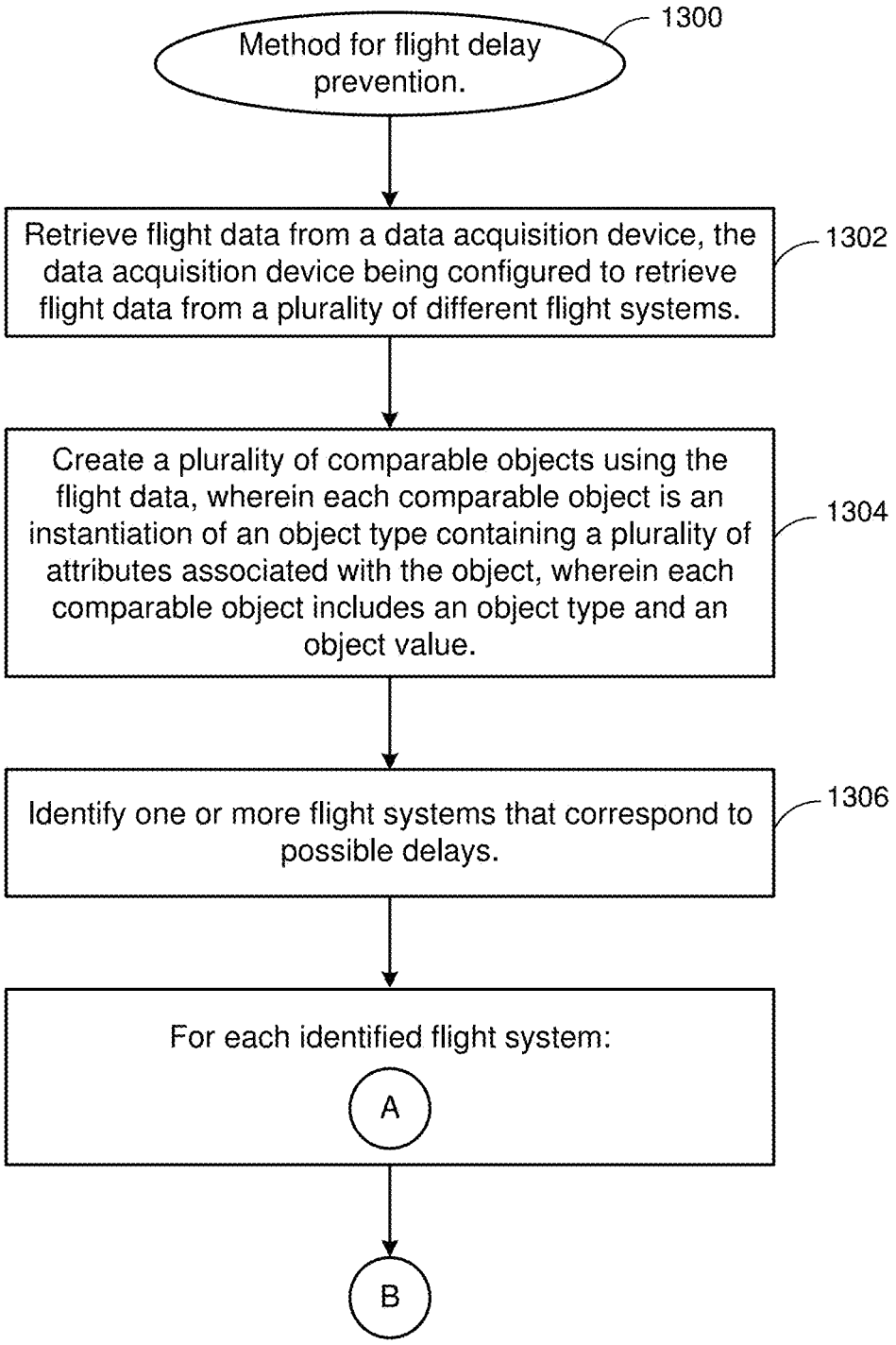
FIGS. 13A-13B illustrate a flow diagram of a method for flight delay prevention, in accordance with one or more embodiments of the present disclosure.
Figure 13B:
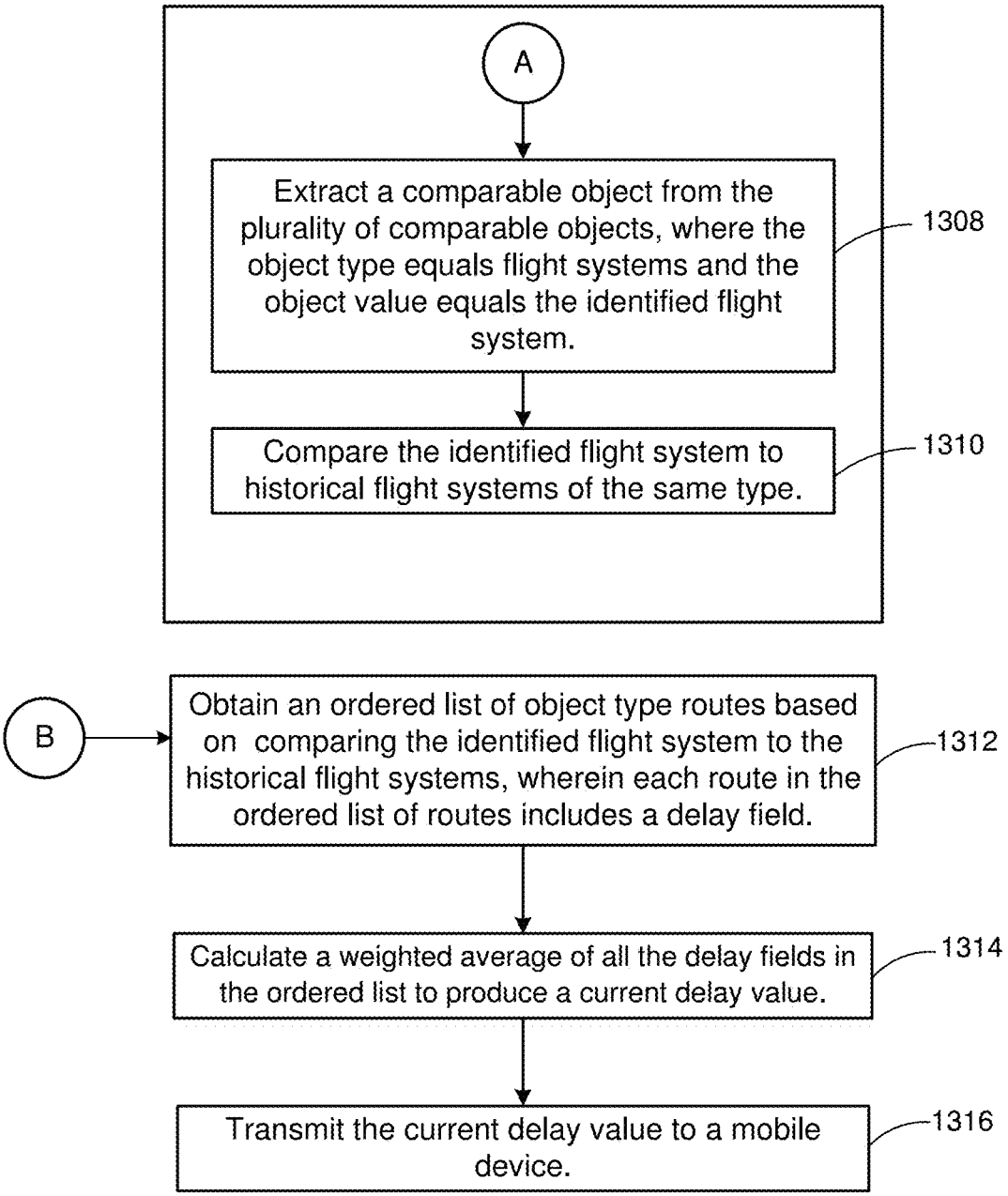

With reference to FIGS. 13A-13B, the present disclosure provides a method for preventing flight delays by comparing flight data of a current flight's route with other past flights sharing similar characteristics, in hopes of circumventing problems which might have occurred within those past flights and, thus preventing the current flight from being delayed. The results from the comparison contain a list of routes which share commonalties with the sought route. The system then collects these commonalties through attribute association which link the results.

The resulting data contains a "delay field" which helps identify potential delays as they relate to each route. The times within this field are calculated using discrepancies between scheduled flight times and actual flight times. The system uses the combined or weighted combined average of these fields to indicate if the sought flight is on time or if it has the potential of being late (i.e. delayed). A detailed description of the method is provided below.

FIGS. 13A-13B illustrate a flow diagram of a method 1300 for flight delay prevention, in accordance with one or more embodiments of the present disclosure. Method 1300 begins with retrieving (1302) flight data from a data acquisition device. In some embodiments, the data acquisition device is configured to retrieve flight data from a plurality of different flight systems.

As previously stated, the ARINC supplies a communication protocol for avionics system used for flight data acquisition and recording systems. The data includes information from all the flight systems within an aircraft and is the primary protocol used between the Digital Flight Data Acquisition Unit (DFDAU) and the Flight Data Recorder, or Black Box. Due to its reach, ARINC Data is ideal for collecting information with concerns to a particular flight.

After the data is retrieved, the system will then create comparable objects and attributes from the binary data obtained from the AID. In some embodiments, the AID contains a software module for handling this functionality. Thus, method 1300 proceeds with creating (1304) a plurality of comparable objects using the flight data. In some embodiments, each comparable object is an instantiation of an object type containing a plurality of attributes associated with the object. In some embodiments, each comparable object includes an object type and an object value.

Once comparable objects are created, the system needs to identify all flight systems which might influence a potential delay in order to evaluate only those systems. Thus, method 1300 continues with identifying (1306) one or more flight systems that correspond to possible delays. For each identified flight system, a comparable object from the plurality of comparable objects is extracted (1308). In some embodiments, the object type equals flight systems and the object value equals the identified flight system. Also for each identified flight system, the identified flight system is compared (1310) to historical flight systems of the same type. Next, method 1300 proceeds with obtaining (1312) an ordered list of object type routes based on comparing the identified flight system to the historical flight systems. In some embodiments, each route in the ordered list of routes includes a delay field. After obtaining an ordered list, a weighted average of all the delay fields in the ordered list to produce a current delay value is calculated (1314). Last, after calculating the weighted average, the current delay value to a mobile device is transmitted (1316) to the mobile device.

In some embodiments, the plurality of attributes comprises physical and non-physical attributes. In some embodiments, a weight for the weighted average is determined by a score for the ordered list as a result of comparing the identified flight system to the historical flight systems, wherein the score is a real number between 0 and 1. In some embodiments, the flight data is binary data, the binary data having a structure of frames, sub-frames, and systems. In some embodiments, creating the plurality of comparable objects includes mapping binary flight data into system objects. In some embodiments, comparing identified flight system includes comparing object type system data to produce object type route data. In some embodiments, the method further comprises transmitting a delay source and alternative routes.

Figure 14:
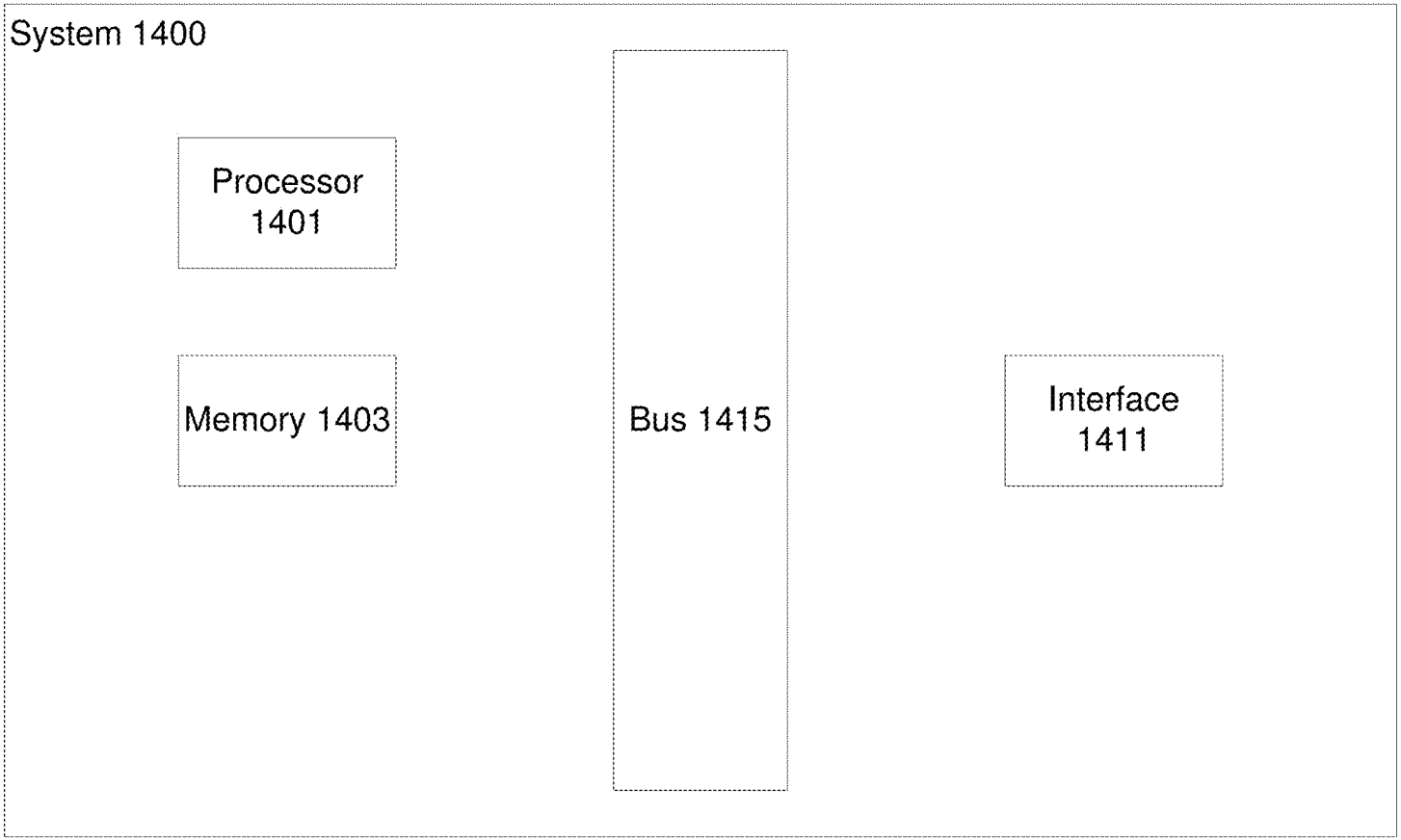
FIG. 14 illustrates a block diagram of an example of a system capable of implementing various processes described herein, in accordance with one or more embodiments of the present disclosure.

FIG. 14 is a block diagram illustrating an example of a system 1400 capable of implementing various processes described in the present disclosure. According to particular embodiments, a system 1400, suitable for implementing particular embodiments of the present disclosure, includes a processor 1401, a memory 1403, an interface 1411, and a bus 1415 (e.g., a Peripheral Component Interconnect (PCI) bus or other interconnection fabric) and operates as a streaming server. In some embodiments, when acting under the control of appropriate software or firmware, the processor 1401 is responsible for the various steps described in FIGS. 13A-13B. Various specially configured devices can also be used in place of a processor 1401 or in addition to processor 1401. In other embodiments, system 1400 may also include one or more of the following elements: a pump, a timing element, a heating element, a thermostat, and a concentration detector.

The interface 1411 is typically configured to send and receive data packets or data segments over a network. Particular examples of interfaces supports include Ethernet interfaces, frame relay interfaces, cable interfaces, Digital Subscriber Line (DSL) interfaces, token ring interfaces, and the like. In addition, various very high-speed interfaces may be provided such as fast Ethernet interfaces, Gigabit Ethernet interfaces, Asynchronous Transfer Mode (ATM) interfaces, High Speed Serial (HSS) interfaces, Point of Sale (POS) interfaces, Fiber Distributed Data (FDD) interfaces and the like. Generally, these interfaces may include ports appropriate for communication with the appropriate media. In some cases, they may also include an independent processor and, in some instances, volatile Random Access Memory (RAM). The independent processors may control such communications intensive tasks as packet switching, media control and management.

According to particular example embodiments, the system 1400 uses memory 1403 to store data and program instructions for operations including all steps presented in FIGS. 13A-13B. The program instructions may control the operation of an operating system and/or one or more applications, for example. The memory or memories may also be configured to store received metadata and batch requested metadata.

Because such information and program instructions may be employed to implement the systems/methods described herein, the present disclosure relates to tangible, or non-transitory, machine readable media that include program instructions, state information, etc. for performing various operations described herein. Examples of machine-readable media include hard disks, floppy disks, magnetic tape, optical media such as CD-ROM disks and DVDs; magneto-optical media such as optical disks, and hardware devices that are specially configured to store and perform program instructions, such as read-only memory devices (ROM) and programmable read-only memory devices (PROMs). Examples of program instructions include both machine code, such as produced by a compiler, and files containing higher level code that may be executed by the computer using an interpreter.

Examples of Aircraft and Methods of Fabricating and Operating Aircraft

Figure 15:
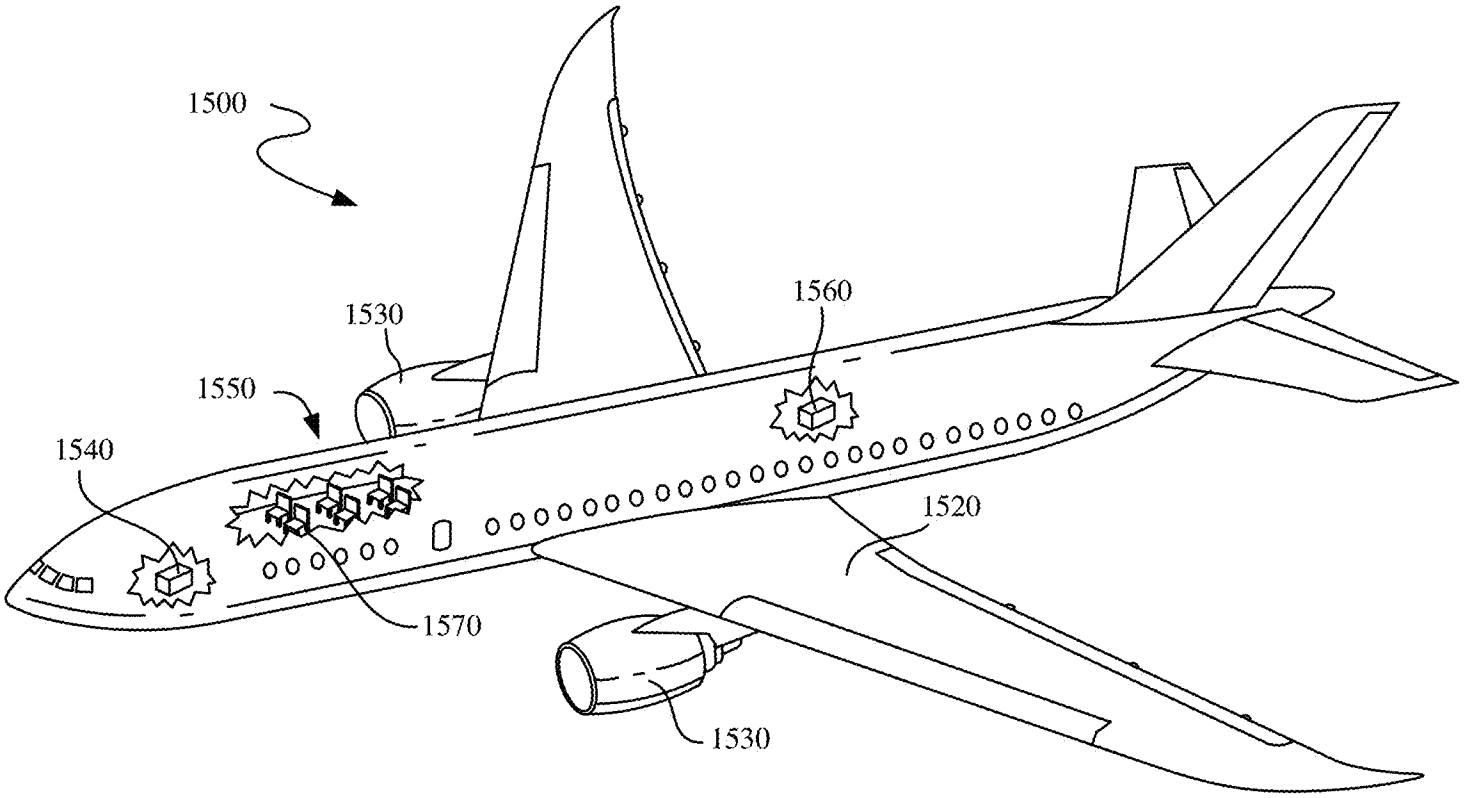
FIG. 15 illustrates a schematic illustration of an aircraft, in accordance with one or more embodiments of the present disclosure.

To better understand various aspects of implementation of the described systems and techniques, a brief description of an aircraft and aircraft wing is now presented. FIG. 15 is a schematic illustration of aircraft 1500, in accordance with some embodiments. As depicted in FIG. 15, aircraft 1500 is defined by a longitudinal axis (X-axis), a lateral axis (Y-axis), and a vertical axis (Z-axis). In various embodiments, aircraft 1500 comprises airframe 1550 with interior 1570. Aircraft 1500 includes wings 1520 coupled to airframe 1550. Aircraft 1500 may also include engines 1530 supported by wings 1520. In some embodiments, aircraft 1500 further includes a number of high-level inspection systems such as electrical inspection system 1540 and environmental inspection system 1560. In other embodiments, any number of other inspection systems may be included.

Aircraft 1500 shown in FIG. 15 is one example of a vehicle of which components may be utilized with the disclosed systems and/or devices, in accordance with illustrative embodiments. Although an aerospace example is shown, the principles disclosed herein may be applied to other industries, such as the automotive industry. Accordingly, in addition to aircraft 1500, the principles disclosed herein may apply to other vehicles, e.g., land vehicles, marine vehicles, space vehicles, etc.

Figure 16:
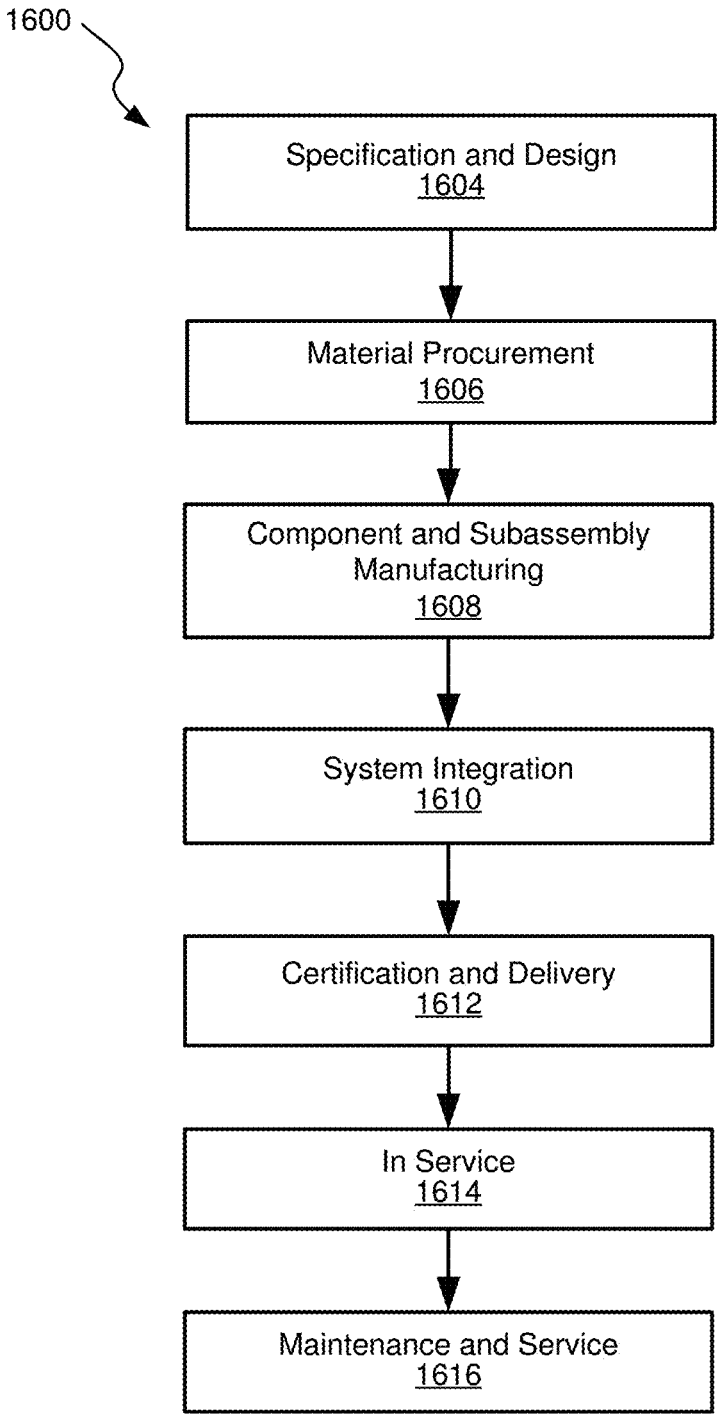
FIG. 16 illustrates an aircraft manufacturing and service method for the aircraft shown in FIG. 15.

Examples of the present disclosure may be described in the context of aircraft manufacturing and service method 1600 as shown in FIG. 16 and aircraft 1500 as shown in FIG. 15. During pre-production, illustrative method 1600 may include specification and design (block 1604) of aircraft 1500 and material procurement (block 1606). During production, component and subassembly manufacturing (block 1608) and inspection system integration (block 1610) of aircraft 1500 may take place. Described methods, and assemblies formed by these methods, can be used in any of specification and design (block 1604) of aircraft 1500, material procurement (block 1606), component and subassembly manufacturing (block 1608), and/or inspection system integration (block 1610) of aircraft 1500.

Thereafter, aircraft 1500 may go through certification and delivery (block 1612) to be placed in service (block 1614). While in service, aircraft 1500 may be scheduled for routine maintenance and service (block 1616). Routine maintenance and service may include modification, reconfiguration, refurbishment, etc. of one or more inspection systems of aircraft 1500. Described methods, and assemblies formed by these methods, can be used in any of certification and delivery (block 1612), service (block 1614), and/or routine maintenance and service (block 1616).

Each of the processes of illustrative method 1600 may be performed or carried out by an inspection system integrator, a third party, and/or an operator (e.g., a customer). For the purposes of this description, an inspection system integrator may include, without limitation, any number of aircraft manufacturers and major-inspection system subcontractors; a third party may include, without limitation, any number of vendors, subcontractors, and suppliers; and an operator may be an airline, leasing company, military entity, service organization, and so on.

Apparatus(es) and method(s) shown or described herein may be employed during any one or more of the stages of manufacturing and service method (illustrative method 1600). For example, components or subassemblies corresponding to component and subassembly manufacturing (block 1608) may be fabricated or manufactured in a manner similar to components or subassemblies produced while aircraft 1500 is in service (block 1614). Also, one or more examples of the apparatus(es), method(s), or combination thereof may be utilized during production stages (block 1608) and (block 1610), for example, by substantially expediting assembly of or reducing the cost of aircraft 1500. Similarly, one or more examples of the apparatus or method realizations, or a combination thereof, may be utilized, for example and without limitation, while aircraft 1500 is in service (block 1614) and/or during maintenance and service (block 1616).

While the present disclosure has been particularly shown and described with reference to specific embodiments thereof, it will be understood by those skilled in the art that changes in the form and details of the disclosed embodiments may be made without departing from the spirit or scope of the present disclosure. It is therefore intended that the present disclosure be interpreted to include all variations and equivalents that fall within the true spirit and scope of the present disclosure. Although many of the components and processes are described above in the singular for convenience, it will be appreciated by one of skill in the art that multiple components and repeated processes can also be used to practice the techniques of the present disclosure.

The invention claimed is:

1. A system comprising:

a mobile device;

a portable data acquisition device, the data acquisition device configured to connect to an Aeronautical Radio Inc. (ARINC) communication port of an aircraft to retrieve binary flight data from a plurality of different flight systems and comprising:

a processor; and a memory, the memory storing instructions for performing operations comprising:

retrieving the binary flight data from the plurality of different flight systems;

creating a plurality of ARINC format comparable objects using the binary flight data, wherein each ARINC format comparable object comprises an object value associated with a type of the flight system;

identifying one or more of the plurality of fight systems that correspond to possible delays;

for each identified flight system:

extracting the ARINC format comparable object from the plurality of ARINC comparable objects;

identifying historical flight systems data that include object values corresponding to the object value of the identified flight system; and comparing the identified flight system to the historical flight systems data of the same object value to determine a characteristic match between the identified flight system and each of the historical flight systems;

obtaining an ordered list of routes based on the characteristic match between the identified flight system and the historical flight systems, wherein each route in the ordered list of routes includes a delay field;

calculating a weighted average of all the delay fields in the ordered list to produce a current delay value, wherein the characteristic match is associated with a weight for each of the delay fields; and transmitting the current delay value to the mobile device.

2. The system of claim 1, wherein the ARINC format comparable object further comprises physical and non-physical attributes of the identified flight systems.

3. The system of claim 1, wherein a weight for the weighted average is determined by a score for the ordered list as a result of comparing the identified flight system to the historical flight systems, wherein the score is a real number between 0 and 1.

4. The system of claim 1, wherein the binary flight data comprises a structure of frames, sub-frames, and systems.

5. The system of claim 1, wherein creating the plurality of ARINC format comparable objects comprises mapping the binary flight data into ARINC format system objects.

6. The system of claim 1, wherein comparing the identified flight system comprises comparing the ARINC format comparable object of the identified flight system to the characteristic matched historical flight systems to produce route data.

7. The system of claim 1, wherein the operations further comprises transmitting a delay source and alternative routes.

8. A method comprising:

retrieving, with a portable data acquisition device, binary flight data from a plurality of different flight systems, the portable data acquisition device configured to connect to an Aeronautical Radio Inc. (ARINC) communication port of an aircraft to retrieve the binary flight data from the plurality of different flight systems;

creating a plurality of ARINC format comparable objects using the binary flight data, wherein each ARINC format comparable object comprises an object value associated with a type of the flight system;

identifying one or more of the plurality of flight systems that correspond to possible delays;

for each identified flight system:

extracting the ARINC format comparable object from the plurality of ARINC comparable objects;

identifying historical flight systems data that include object values corresponding to the object value of the identified flight system; and comparing the identified fight system to the historical flight systems data of the same object value to determine a characteristic match between the identified flight system and each of the historical fight systems;

obtaining an ordered list of routes based on the characteristic match between the identified flight system and the historical flight systems, wherein each route in the ordered list of routes includes a delay field;

calculating a weighted average of all the delay fields in the ordered list to produce a current delay value, wherein the characteristic match is associated with a weight for each of the delay fields; and transmitting the current delay value to a mobile device.

9. The method of claim 8, wherein the ARINC format comparable object further comprises physical and non-physical attributes of the identified flight systems.

10. The method of claim 8, wherein a weight for the weighted average is determined by a score for the ordered list as a result of comparing the identified flight system to the historical flight systems, wherein the score is a real number between 0 and 1.

11. The method of claim 8, wherein the binary flight data comprises a structure of frames, sub-frames, and systems.

12. The method of claim 8, wherein creating the plurality of ARINC format comparable objects comprises mapping the binary flight data into ARINC format system objects.

13. The method of claim 8, wherein comparing the identified flight system comprises comparing the ARINC format comparable object of the identified flight system to the characteristic matched historical flight systems to produce route data.

14. The method of claim 8, further comprising transmitting a delay source and alternative routes.

15. A non-transitory computer readable medium storing instructions to perform operations comprising:

retrieving, with a portable data acquisition device, binary flight data from a plurality of different flight systems, the portable data acquisition device configured to connect to an Aeronautical Radio Inc. (ARINC) communication port of an aircraft to retrieve the binary flight data from the plurality of different flight systems;

creating a plurality of ARINC format comparable objects using the binary flight data, wherein each ARINC format comparable object comprises an object value associated with a type of the flight system;

identifying one or more of the plurality of flight systems that correspond to possible delays;

for each identified flight system:

extracting the ARINC format comparable object from the plurality of ARINC comparable objects;

identifying historical flight systems data that include object values corresponding to the object value of the identified flight system; and comparing the identified flight system to the historical flight systems data of the same object value to determine a characteristic match between the identified flight system and each of the historical flight systems;

obtaining an ordered list of routes based on the characteristic match between the identified flight system and the historical flight systems, wherein each route in the ordered list of routes includes a delay field;

calculating a weighted average of all the delay fields in the ordered list to produce a current delay value, wherein the characteristic match is associated with a weight for each of the delay fields; and transmitting the current delay value to a mobile device.

16. The non-transitory computer readable medium of claim 15, wherein the ARINC format comparable object further comprises physical and non-physical attributes of the identified flight systems.

17. The non-transitory computer readable medium of claim 15, wherein a weight for the weighted average is determined by a score for the ordered list as a result of comparing the identified flight system to the historical flight systems, wherein the score is a real number between 0 and 1.

18. The non-transitory computer readable medium of claim 15, wherein the binary flight data comprises a structure of frames, sub-frames, and systems.

19. The non-transitory computer readable medium of claim 15. wherein creating the plurality of ARINC format comparable objects comprises mapping the binary flight data into ARINC format system objects.

20. The non-transitory computer readable medium of claim 15, wherein comparing the identified flight system comprises comparing the ARINC format comparable object of the identified flight system to the characteristic matched historical flight systems to produce route data.

* * * * *